US006592348B1

(12) United States Patent
Johnson

(10) Patent No.: US 6,592,348 B1
(45) Date of Patent: Jul. 15, 2003

(54) LUBRICANT PUMP AND METHOD OF PRODUCING

(75) Inventor: Stephen D. Johnson, Hanover, MI (US)

(73) Assignee: Production Research, Inc, Toledo, OH (US)

( * ) Notice: Subject to any disclaimer, the term of this patent is extended or adjusted under 35 U.S.C. 154(b) by 0 days.

(21) Appl. No.: 10/107,918

(22) Filed: Mar. 27, 2002

(51) Int. Cl.[7] ..... F04C 2/10
(52) U.S. Cl. ..... 418/152; 418/171; 29/888.023
(58) Field of Search ..... 418/152, 166, 418/171; 29/428, 888.023

(56) References Cited

U.S. PATENT DOCUMENTS

| | | | | |
|---|---|---|---|---|
| 3,170,409 A | * | 2/1965 | McLeod et al. | 418/171 |
| 4,442,729 A | | 4/1984 | Hayakawa | 74/467 |
| 4,459,208 A | | 7/1984 | Lemon | 210/168 |
| 4,531,421 A | | 7/1985 | Vieth | 74/467 |
| 4,540,347 A | | 9/1985 | Child | 418/171 |
| 4,713,980 A | | 12/1987 | Ida et al. | 74/467 |
| 4,841,803 A | | 6/1989 | Hamano et al. | 74/467 |
| 4,860,612 A | | 8/1989 | Dick et al. | 74/467 |
| 4,938,306 A | | 7/1990 | Sumiyoshi et al. | 74/467 |
| 5,211,262 A | | 5/1993 | Akiyama | 74/467 |
| 5,302,158 A | | 4/1994 | Kwasniewski | 74/467 |
| 5,522,477 A | | 6/1996 | Byrne | 74/467 |
| 5,634,530 A | | 6/1997 | Maekawa et al. | 74/467 |
| 5,740,697 A | | 4/1998 | Yamase | 74/467 |
| 6,017,202 A | | 1/2000 | Durnack et al. | 418/171 |
| 6,053,718 A | * | 4/2000 | Schmidt et al. | 418/152 |

FOREIGN PATENT DOCUMENTS

| | | | |
|---|---|---|---|
| DE | 4214752 | * 11/1993 | 418/166 |

* cited by examiner

*Primary Examiner*—John J. Vrablik
(74) *Attorney, Agent, or Firm*—MacMillan, Sobanski & Todd, LLC

(57) ABSTRACT

A rotary type lubrication pump for a vehicle transfer case and a method of producing the lubrication pump, the lubrication pump having an inner gear and an outer gear produced by molding a synthetic polymer, and a pump body and a pump cover produced by stamping steel.

20 Claims, 3 Drawing Sheets

LUBRICANT PUMP AND METHOD OF PRODUCING

FIELD OF THE INVENTION

The invention relates to a lubrication pump and a method of producing the lubrication pump, and more particularly to a lubrication pump for a vehicle transfer case which pumps a lubricant through a passageway in an axial bore of a shaft.

BACKGROUND OF THE INVENTION

A four wheel drive vehicle includes a vehicle transfer case for distributing a driving force from a transmission connected to a prime mover such as an internal combustion engine to front and rear wheels through a vehicle drive train assembly. The transfer case is adapted to be secured to one end of the vehicle transmission. An input shaft is rotatably supported within the transfer case for coupling with an output shaft of the vehicle transmission. The input shaft of the transfer case is coupled to a speed change mechanism which is then coupled to an output shaft of the transfer case. The output shaft of the transfer case is then coupled with the vehicle drive train assembly. Lubrication of a plurality of bearings within the transfer case is accomplished by a pumping mechanism, such as a gerotor pump, which is mounted on the input shaft of the transfer case and pumps a lubricant through an axial bore of the input shaft.

Typically, pumping mechanisms have been constructed of cast aluminum which has been precision machined. Restriction of the total weight, durability, and temperature resistance of materials used to produce the pumps are a concern for design of the pumping mechanism.

It would be desirable to produce a lubrication pump for a vehicle transfer case in which weight is minimized and durability and temperature resistance are maximized.

SUMMARY OF THE INVENTION

Consistent and consonant with the present invention, a lubrication pump for a vehicle transfer case in which weight is minimized and durability and temperature resistance are maximized has surprisingly been discovered. The lubrication pump for a vehicle transfer case comprises:

a pump body having a generally hollow cylindrical shape and a central longitudinal axis, one end of the pump body having a radial wall with a centrally disposed aperture;

a synthetic polymer pump insert having a generally cylindrical main body with a central aperture, an inlet channel, and an outlet channel, the inlet channel in fluid communication with a source of lubricating fluid and the outlet channel in fluid communication with the central aperture of the main body, the pump insert inserted in the pump body;

a synthetic polymer outer gear, the outer gear being generally ring shaped with an inner surface forming an aperture, the inner surface having a generally sinusoidal shape which forms a plurality of peaks and valleys, the outer gear received in the pump body adjacent the pump insert;

a synthetic polymer inner gear, the inner gear being generally disc shaped with a central aperture formed by an inner surface, the inner surface having a shaft engaging portion to drivingly engage the inner gear with a shaft of a vehicle transfer case, an outer surface of the inner gear having a generally sinusoidal shape which forms a plurality of peaks and valleys, the number of peaks and valleys of the outer surface of the inner gear being at least one less than the number of peaks and valleys of the inner surface of the outer gear, the inner gear rotatingly received in the central aperture of the outer gear adjacent the pump insert; and a generally disc shaped pump cover having a central aperture, the pump cover attached to the pump body to enclose the pump insert, the outer gear and the inner gear within the pump body and form a substantially liquid tight seal with the pump body.

BRIEF DESCRIPTION OF THE DRAWINGS

The above, as well as other objects, features, and advantages of the present invention will be understood from the detailed description of the preferred embodiments of the present invention with reference to the accompanying drawings, in which.

DETAILED DESCRIPTION OF THE PREFERRED EMBODIMENTS

Figure 1:
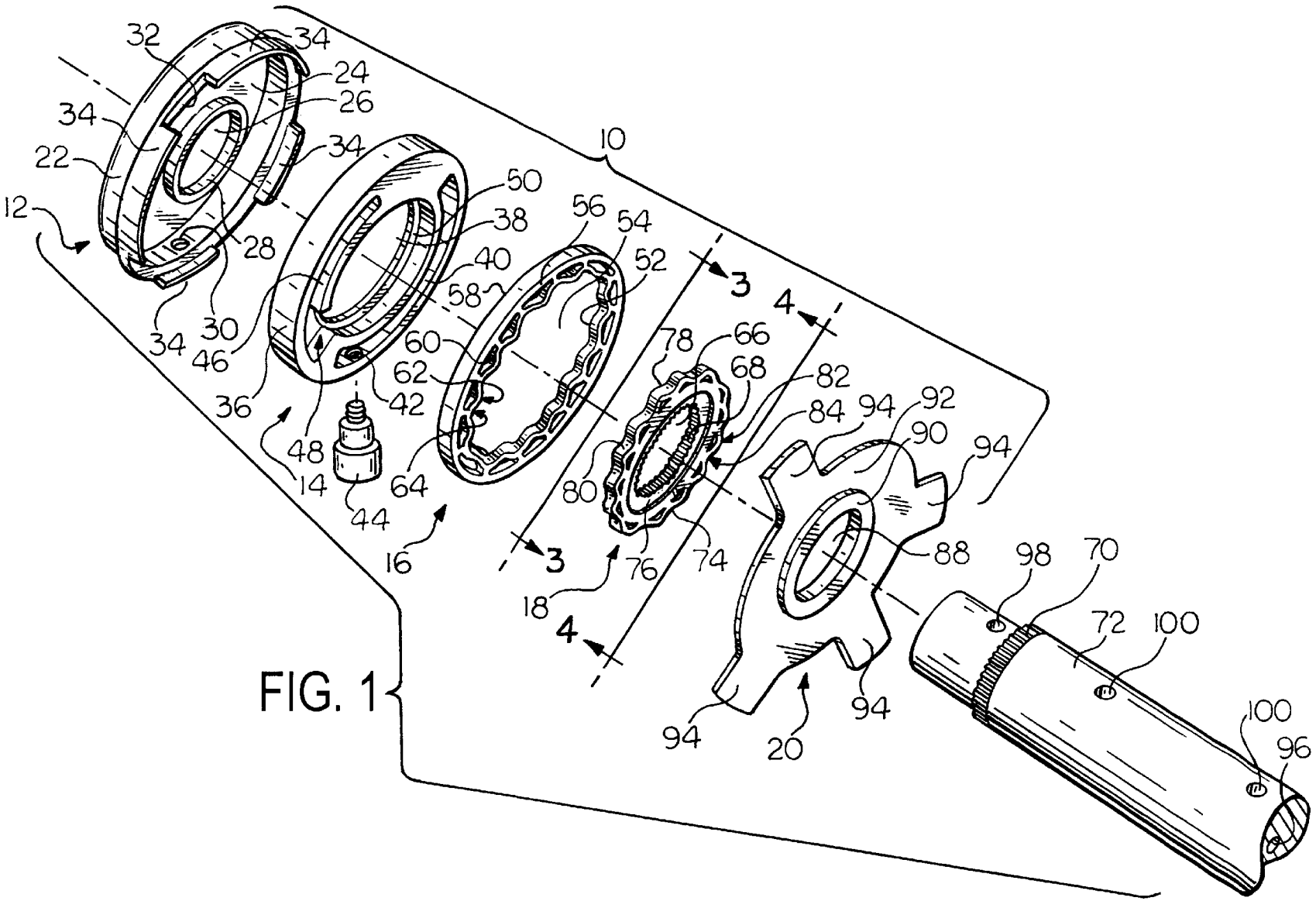
FIG. 1 is an exploded perspective view of a lubrication pump for a vehicle transfer case incorporating the features of the invention.

Referring now to the drawings, and particularly FIG. 1, there is shown generally at 10 a lubrication pump for a vehicle transfer case incorporating the features of the invention. The lubrication pump 10 includes a pump body 12, a pump insert 14, an outer gear 16, an inner gear 18, and a pump cover 20.

The pump body 12 has a hollow cylindrical shape with an outer wall 22. One end of the pump body 12 has a radial wall 24 surrounding a central aperture 26. A lip 28 is formed at an inner edge of the radial wall 24 surrounding the central aperture 26. An inlet aperture 30 is formed in the outer wall 22. A radial ledge 32 extends radially outward from the end of the outer wall 22 opposite the radial wall 24. The radial ledge 32 is ring shaped, having an inner portion of the ring attached to the outer wall 22. An annular array of spaced apart extensions 34 are formed at an outer edge of the ring shaped radial ledge 32. The extensions 34 extend in an axial direction from the outer edge of the radial ledge 32. In the embodiment shown, the pump body 12 is produced from stamped steel. It is understood that other methods such as precision machining, for example, or other materials, such as a synthetic polymer, for example, could be used to produce the pump body 12.

Figure 2:
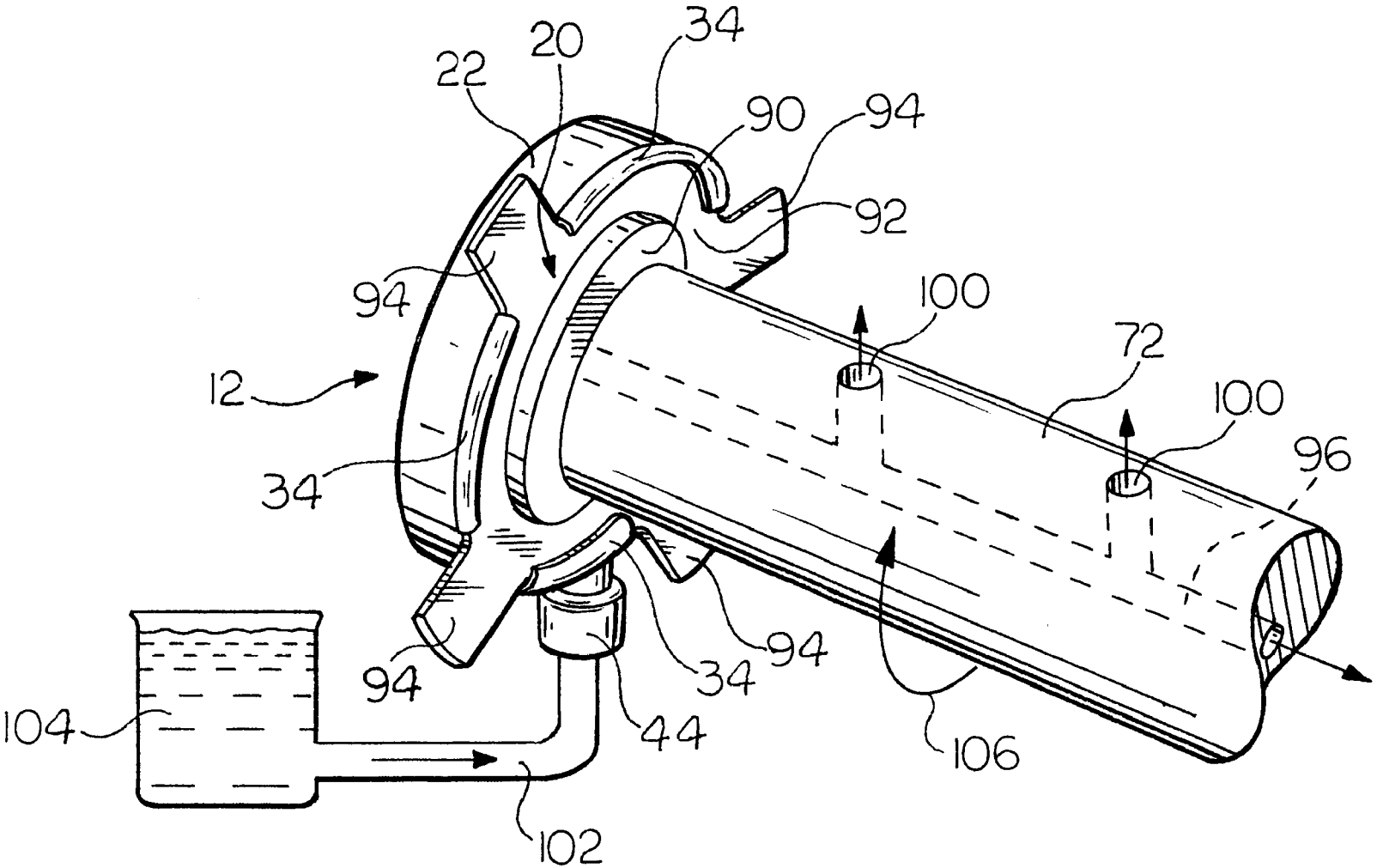
FIG. 2 is a schematic view of the lubrication pump for a vehicle transfer case illustrated in FIG. 1.

The pump insert 14 has a cylindrical main body 36 with a centrally disposed aperture 38. An arcuate inlet channel 40 is disposed in the main body 36 and is in fluid communication with an inlet aperture 42. The inlet aperture 42 is adapted to receive an inlet adapter 44 which is in fluid communication with a source of lubricating fluid 104, as illustrated in FIG. 2. An arcuate outlet channel 46 is disposed in the main body 36 radially opposite the inlet channel 40. An outlet opening 48 facilitates fluid communication between the outlet channel 46 and the aperture 38. An annular ridge 50 is disposed on the inner surface of the main body 36 which forms the aperture 38.

The outer gear 16 consists of an annular ring having a generally sinusoidal inner surface 52 which forms an aperture 54. A front face 56 and a rear face 58 contain a plurality of recessed portions 60 defined by the peaks 62 and the valleys 64 of the sinusoidal inner surface 52. In the embodiment shown, there are fifteen peaks 62 and fifteen valleys 64 formed on the sinusoidal inner surface 52. It is understood that an inner surface 52 having more or fewer peaks 62 and valleys 64 can be used without departing from the scope and spirit of the invention.

Figure 3:
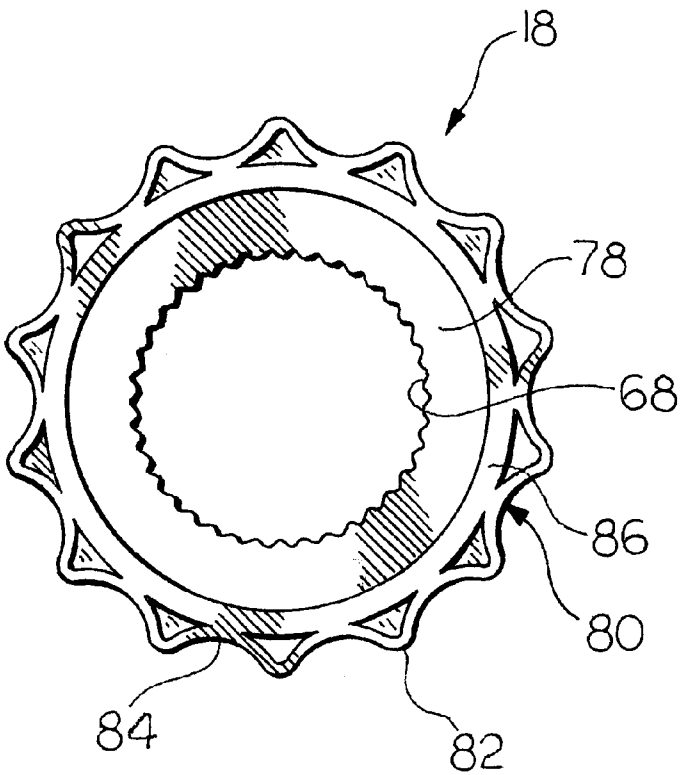
FIG. 3 is a partial elevation view of the inner gear of the lubrication pump taken along line 3—3 of FIG. 1.

The inner gear 18 consists of a disc having a central aperture 66. In the embodiment shown, the inner surface 68 of the inner gear 18 is serrated to receive a serrated portion 70 of a shaft 72. It is understood that other engaging surfaces between the inner gear 18 and the shaft 72 can be used such as a single D or a double D, for example, without departing from the scope and spirit of the invention. A front face 74 of the inner gear 18 has an annular ring 76 surrounding the central aperture 66. An outer surface 80 has a generally sinusoidal shape or annular array of lobes having a plurality of peaks 82 and valleys 84. In the embodiment shown, there are fourteen peaks 82 and fourteen valleys 84 formed in the sinusoidal outer surface 80 of the inner gear 18. It is understood that an outer surface 80 having more or fewer peaks 82 and valleys 84 can be used without departing from the scope and spirit of the invention. The number of peaks 82 and valleys 84 formed on the outer surface 80 will ideally be one less than the number of peaks 62 and valleys 64 formed on the inner surface 52 of the outer gear 16. It is understood that the difference between the number of peaks 82 and valleys 84 formed on the outer surface 80 of the inner gear 18 and the number of peaks 62 and valleys 64 formed on the inner surface 52 of the outer gear 16 can be greater than one. As illustrated in FIG. 3, a rear face 78 has an annular ring 86 formed thereon adjacent and radially inward of the outer surface 80.

In the embodiment shown, glass filled nylon is used to produce the pump insert 14, the inlet adapter 44, the outer gear 16, and the inner gear 18. Glass percentages up to 60 percent have been found to perform satisfactorily. A glass percentage of 35 percent has been found to provide optimal performance. Additionally, nylon without a glass filler has also been found to perform satisfactorily as a material of construction for the pump insert 14, the inlet adapter 44, the outer gear 16, and the inner gear 18. It is also understood that other synthetic polymers could be used without departing from the scope and spirit of the invention.

The pump cover 20 consists of a disc having a central aperture 88 formed in an annular ring 90 which is offset in the direction of a front face 92. A plurality of protuberances 94 form an anti-rotation structure and extend radially from the pump cover 20. It is understood that the anti-rotation structure could be formed on the pump body 12 as well. In the embodiment shown, the pump cover 20 is produced from stamped steel. It is understood that other methods such as precision machining, for example, or other materials, such as a synthetic polymer, for example, could be used to produce the pump cover 20.

The shaft 72 includes an axial bore 96 as illustrated in FIG. 2. A radial aperture 98 which communicates with the axial bore 96 is disposed in one end of the shaft 72 adjacent the serrated portion 70. A plurality of spaced apart lubrication apertures 100 are in fluid communication with the axial bore 96 and extend radially therefrom.

Figure 4:
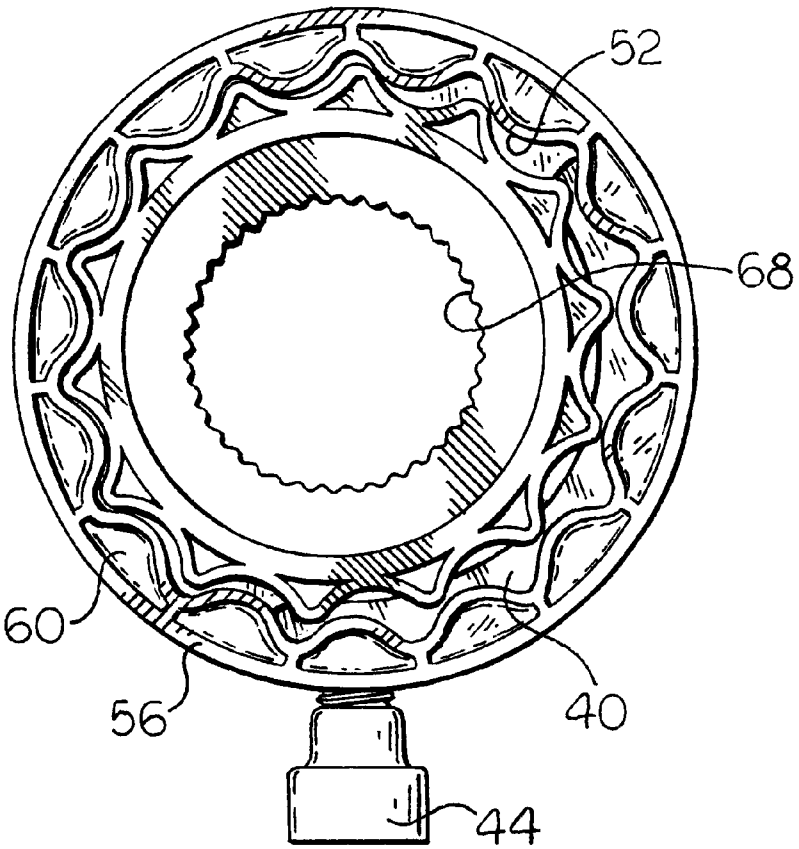
FIG. 4 is a partial elevation view of the inner gear, the outer gear, the pump insert, and the inlet adapter of the lubrication pump taken along line 4—4 of FIG. 1.

To assemble the lubrication pump 10, the pump insert 14 is inserted into the hollow portion of the pump body 12 in the orientation shown in FIG. 1. The inner gear 18 is mated to the outer gear 16 as illustrated in FIG. 4 and inserted into the pump body 12 adjacent the pump insert 14. The pump cover 20 is mated to the pump body 12 such that the protuberances 94 are disposed between the extensions 34. The extensions 34 of the pump body 12 are then hemmed to join the pump body 12 and the pump cover 20 to enclose the pump insert 14, the outer gear 16, and the inner gear 18 therein. The inlet adapter 44 is then inserted through the inlet aperture 30 of the pump body 12 and releasably fastened to the inlet aperture 42 of the pump insert 14. Once the lubrication pump 10 is assembled, the lubrication pump 10 is placed on the shaft 72 by sliding the shaft 72 through the central aperture 88 of the pump cover 20. The serrated portion 70 of the shaft 72 is mated with the inner surface 68 of the inner gear 18. The radial aperture 98 of the shaft 72 is disposed adjacent the inner surface of the pump insert 14 to facilitate fluid communication with the outlet opening 48 of the outlet channel 46. The end of the shaft 72 is then slid through the central aperture 26 of the pump body 12. The shaft 72 forms a substantially liquid tight seal with the pump body 12 and the pump cover 20.

In the embodiment shown, the inlet adapter 44 is releasably fastened to the inlet aperture 42 of the pump insert 14 by a screwed connection. It is understood that other connection methods could be used. A conduit 102 fluidly connects the inlet aperture 42 with a source of lubricating fluid 104, as schematically illustrated in FIG. 2. A typical lubricating fluid used is automatic transmission fluid with or without additives, although it is understood that other lubricating fluids may be used.

In operation, the shaft 72 is caused to rotate in the clockwise direction, as depicted by the arrow 106 in FIG. 2, by connection to a driving mechanism such as a transmission of an automobile (not shown). In turn, the inner gear 18 is caused to rotate within the outer gear 16. Since there are fewer peaks 82 and valleys 84 in the inner gear than there are peaks 62 and valleys 64 in the outer gear 16, the inner gear 18 is permitted to rotate without causing the outer gear 16 to rotate. As the inner gear 18 rotates, lubrication fluid is caused to be pumped from the source of lubrication fluid 104, through the conduit 102, and into the lubrication pump 10. Within the lubrication pump 10, the fluid moves through the inlet aperture 42, through the inlet channel 40, through the outer gear 16 and the inner gear 18, through the outlet channel 46 and the outlet opening 48, through the radial aperture 98 and through the axial bore 96. The lubrication fluid is then caused to flow through the plurality of lubrication apertures 100 to lubricate bearings (not shown). The protuberances 94 militate against rotation of the lubrication pump 10 with the shaft 72 by abutting surfaces of the vehicle transfer case (not shown) adapted to receive the protuberances 94.

Since the lubrication pump 10 is typically hidden from view and not easily inspected, it is critical that the lubrication pump 10 be reliable in its operation. The nature of the design of the lubrication pump 10 is such that pump prime must be maintained, or insufficient lubrication fluid may be pumped to the bearings. The extent of the prime required for the lubrication pump 10 to operate efficiently is a function of the amount of clearance between the outer gear 16 and the inner gear 18 and the pump body 12 and pump cover 20. Since the operating temperature of the lubrication pump 10 is typically approximately 250 degrees Fahrenheit, the thermal expansion of the lubrication pump 10 components becomes important. Nylon having 35 percent glass filler has an expansion coefficient of approximately 0.00008 inches per inches-degree Fahrenheit. Nylon with 60 percent glass filler has an expansion coefficient of approximately 0.00004 inches per inches-degree Fahrenheit. Due to the expansion characteristics of nylon and glass filled nylon versus that of steel, the efficiency of the lubrication pump 10 increases as the operating temperature increases. This is not true with pumps of the prior art using an aluminum pump body and cover with powdered metal gears.

By using molded parts produced from nylon and glass filled nylon, machining costs are minimized. No precision machining is required. Lubrication pumps having inner and outer gears produced from powdered metal typically require precision machining, adding to cost and complexity of production.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A method of producing a lubrication pump for a vehicle transfer case, the method comprising:

forming a pump body, the pump body having a generally hollow cylindrical shape and a central longitudinal axis, one end of the pump body having a radial wall with a centrally disposed aperture;

molding a pump insert from a synthetic polymer, the pump insert having a generally cylindrical main body with a central aperture, an inlet channel formed in the main body and adapted for fluid communication with a source of lubricating fluid, and an outlet channel formed in the main body in fluid communication with the central aperture of the main body;

molding an outer gear from a synthetic polymer, the outer gear being generally ring shaped with an inner surface forming an aperture, the inner surface having a generally sinusoidal shape which forms a plurality of peaks and valleys;

molding an inner gear from a synthetic polymer, the inner gear being generally disc shaped with a central aperture formed by an inner surface, the inner surface having a shaft engaging portion to drivingly engage the inner gear with a shaft of a vehicle transfer case, an outer surface of the inner gear having a generally sinusoidal shape which forms a plurality of peaks and valleys, the number of peaks and valleys being at least one less than the number of peaks and valleys of the inner surface of the outer gear, the inner gear rotatingly received in the central aperture of the outer gear;

forming a pump cover, the pump cover being generally disc shaped and having a central aperture;

inserting the pump insert into the pump body;

mating the inner gear and the outer gear by aligning at least one of the valleys of the outer gear with at least one of the peaks of the inner gear and inserting the mated inner gear and outer gear into the pump body adjacent the pump insert;

joining the pump cover and the pump body to form a substantially liquid tight seal between the pump body and the pump cover.

2. The method according to claim 1, wherein the pump body is formed by stamping steel.

3. The method according to claim 1, wherein the pump cover is formed by stamping steel.

4. The method according to claim 1, wherein the pump insert is molded with nylon having 0–60 percent glass filler based upon the total weight of the pump insert.

5. The method according to claim 1, wherein the inner gear is molded with nylon having 0–60 percent glass filler based upon the total weight of the inner gear.

6. The method according to claim 1, wherein the outer gear is molded with nylon having 0–60 percent glass filler based upon the total weight of the outer gear.

7. The method according to claim 1, wherein the pump insert is molded with nylon having 35 percent glass filler based upon the total weight of the pump insert.

8. The method according to claim 1, wherein the inner gear is molded with nylon having 35 percent glass filler based upon the total weight of the inner gear.

9. The method according to claim 1, wherein the outer gear is molded with nylon having 35 percent glass filler based upon the total weight of the outer gear.

10. The method according to claim 1 including the step of molding an inlet adapter from a synthetic polymer, the inlet adapter releasably joined with the pump insert and providing fluid communication between the inlet channel and a conduit in fluid communication with the source of lubricating fluid.

11. The method according to claim 10, wherein the inlet adapter is molded with nylon having 0–60 percent glass filler based upon the total weight of the inlet adapter.

12. The method according to claim 10, wherein the inlet adapter is molded with nylon having 35 percent glass filler based upon the total weight of the inlet adapter.

13. The method according to claim 1, wherein the pump body includes an outer wall having at least one extension extending substantially parallel to the longitudinal axis of the pump body and disposed on the end opposite the radial wall, said step of releasably joining the pump cover and pump body includes hemming of the at least one extension of the pump body over the pump cover.

14. A lubrication pump for a vehicle transfer case comprising:

a pump body having a generally hollow cylindrical shape and a central longitudinal axis, one end of said pump body having a radial wall with a centrally disposed aperture;

a synthetic polymer pump insert having a generally cylindrical main body with a central aperture, an inlet channel, and an outlet channel, the inlet channel in fluid communication with a source of lubricating fluid and the outlet channel in fluid communication with the central aperture of said main body, said pump insert inserted in said pump body;

a synthetic polymer outer gear, said outer gear being generally ring shaped with an inner surface forming an aperture, the inner surface having a generally sinusoidal shape which forms a plurality of peaks and valleys, said outer gear received in said pump body adjacent said pump insert;

a synthetic polymer inner gear, said inner gear being generally disc shaped with a central aperture formed by an inner surface, the inner surface having a shaft engaging portion to drivingly engage said inner gear with a shaft of a vehicle transfer case, an outer surface of said inner gear having a generally sinusoidal shape which forms a plurality of peaks and valleys, the number of peaks and valleys of the outer surface of said inner gear being at least one less than the number of peaks and valleys of the inner surface of said outer gear, said inner gear rotatingly received in the central aperture of said outer gear adjacent said pump insert; and a generally disc shaped pump cover having a central aperture, said pump cover releasably fastened to said pump body to enclose said pump insert, said outer gear and said inner gear within said pump body and form a substantially liquid tight seal with said pump body.

15. The lubrication pump according to claim 14, wherein said pump body is formed of stamped steel.

16. The lubrication pump according to claim 14 wherein said pump cover is formed of stamped steel.

17. The lubrication pump according to claim 14 wherein said pump cover includes an anti-rotation structure disposed thereon.

18. The lubrication pump according to claim 17 wherein the anti-rotation structure includes a plurality of protuberances extending radially from said pump cover.

19. The lubrication pump according to claim 14 wherein said pump body includes an outer wall having at least one extension extending substantially parallel to the longitudinal axis of said pump body, the at least one extension disposed on the end opposite the radial wall.

20. The lubrication pump according to claim 19 wherein said pump body and said pump cover are fastened by hemming of the at least one extension over said pump cover.

* * * * *